US009281551B2

(12) United States Patent
Apostolos et al.

(10) Patent No.: US 9,281,551 B2
(45) Date of Patent: Mar. 8, 2016

(54) MULTIBAND WHIP ANTENNA

(71) Applicant: BAE Systems Information and Electronic Systems Integration Inc., Nashua, NH (US)

(72) Inventors: John T. Apostolos, Lyndeborough, NH (US); William Mouyos, Windham, NH (US); Judy Feng, Nashua, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 14/333,019

(22) Filed: Jul. 16, 2014

(65) Prior Publication Data

US 2014/0327488 A1 Nov. 6, 2014

Related U.S. Application Data

(60) Division of application No. 12/928,886, filed on Dec. 22, 2010, now Pat. No. 8,816,925, and a continuation-in-part of application No. 12/436,375, filed on May 6, 2009, now Pat. No. 8,081,130.

(51) Int. Cl.

| | |
|---|---|
| ***H01Q 9/16*** | (2006.01) |
| ***H01P 1/20*** | (2006.01) |
| ***H01Q 5/00*** | (2015.01) |
| ***H01Q 1/10*** | (2006.01) |
| ***H01Q 1/32*** | (2006.01) |
| ***H01P 3/08*** | (2006.01) |
| ***H01Q 5/314*** | (2015.01) |

(52) U.S. Cl.

CPC .. *H01P 1/20* (2013.01); *H01P 3/08* (2013.01); *H01Q 1/10* (2013.01); *H01Q 1/32* (2013.01); *H01Q 5/0031* (2013.01); *H01Q 5/314* (2015.01)

(58) Field of Classification Search

CPC ..... H01P 3/08; H01P 1/20
USPC ..... 333/12, 204, 205; 340/572.7
See application file for complete search history.

(56) References Cited

U.S. PATENT DOCUMENTS

| | | | |
|---|---|---|---|
| 3,576,578 | A | 4/1971 | Harper |
| 3,680,147 | A | 7/1972 | Redlich |
| 3,879,735 | A | 4/1975 | Campbell et al. |
| 3,961,331 | A | 6/1976 | Campbell |
| 4,352,109 | A | 9/1982 | Reynolds et al. |
| 4,369,449 | A | 1/1983 | MacDougall |
| 4,963,879 | A | 10/1990 | Lin |
| 5,079,562 | A | 1/1992 | Yarsunas et al. |

(Continued)

FOREIGN PATENT DOCUMENTS

| | | |
|---|---|---|
| WO | 2009004451 | 1/2009 |

*Primary Examiner* — Stephen E Jones
(74) *Attorney, Agent, or Firm* — Daniel J. Long

(57) ABSTRACT

A multi-band whip antenna having a 30 MHz to 2 GHz bandwidth and an L-band dipole has its coverage extended up to 6 GHz by eliminating nulls and reducing VSWR problems that are cured through the utilization of a sleeve over the feedpoint of the L-band antenna. Chokes in the form of sleeves are provided at either end of the L-band dipole to shorten the L-band antenna for preventing reverse polarity currents at the L-band antenna feedpoint, with the antenna further including the use of double shielded meanderline to provide improved performance between 410-512 MHz and in which a capacitance sleeve is added at the bottom of the L-band antenna to effectively elongate the antenna below the L-band to permit operation below 700 MHz.

1 Claim, 13 Drawing Sheets

(56) References Cited

U.S. PATENT DOCUMENTS

| | | | |
|---|---|---|---|
| 5,506,591 | A | 4/1996 | Dienes |
| 5,790,080 | A | 8/1998 | Apostolos |
| 6,323,814 | B1 | 11/2001 | Apostolos |
| 6,351,241 | B1 | 2/2002 | Wass |
| 6,359,599 | B2 | 3/2002 | Apostolos |
| 6,373,440 | B2 | 4/2002 | Apostolos |
| 6,373,446 | B2 | 4/2002 | Apostolos |
| 6,404,391 | B1 | 6/2002 | Apostolos |
| 6,480,158 | B2 | 11/2002 | Apostolos |
| 6,492,953 | B2 | 12/2002 | Apostolos |
| 6,552,692 | B1 | 4/2003 | Zeilinger et al. |
| 6,985,121 | B1 | 1/2006 | Bogdans et al. |
| 8,593,363 | B2 | 11/2013 | Mclean et al. |
| 2002/0097110 | A1* | 7/2002 | Khan ..... H01P 5/028 333/34 |
| 2007/0159402 | A1 | 7/2007 | Fossett |
| 2008/0143632 | A1 | 6/2008 | Apostolos |

* cited by examiner

Double meander line concept

Sharper cutoff using double meanderlines

MULTIBAND WHIP ANTENNA

RELATED APPLICATIONS

This is a divisional of U.S. patent application Ser. No. 12/928,886 filed Dec. 22, 2010 and is a continuation-in-part of U.S. patent application Ser. No. 12/436,375 filed Mar. 6, 2009, since granted as U.S. Pat. No. 8,081,130 issued Dec. 20, 2011, entitled Broadband Whip Antenna, the contents of which are incorporated herein by reference.

FIELD OF THE INVENTION

This invention relates to broadband communication antennas and more particularly to improvements to a broadband whip antenna which extends continuous coverage from 30 MHz up to above 6 GHz.

BACKGROUND OF THE INVENTION

As discussed in patent application Ser. No. 12/436,375 incorporated herein by reference, the military, police and some commercial installations have vehicles that are provided with a virtual forest of antennas to cover various frequency bands. As a result there is a requirement for continuous coverage in a single antenna that operates between from the VHF bands at 30 megahertz all the way up to the 6 UHF gigahertz frequencies.

In order to be able to provide multi-band coverage, up to 4 or 5 antennas are separately utilized on a vehicle. The bands of interest for the military are the 30-88 megahertz band, the 108-156 megahertz band, the 225-450 megahertz band, the 1350-1550 megahertz band and the 1650-1850 megahertz band.

As mentioned above, there is a necessity for military, law enforcement and even commercial vehicles to be equipped with communication devices to permit operators to exchange information with a variety of different information services, command and control and dispatch centers. Also, GPS coverage is often required for geolocation. While these vehicles can employ multiple separate antennas designed to communicate effectively at a particular frequency range, there is a requirement for a single antenna that may be mounted to existing vehicles so that one antenna can have the gain of legacy antennas, while supplanting the forest of antennas previously utilized.

More particularly, a so-called Sinegars antenna typically operates between 30 megahertz and 88 megahertz, where the 30 megahertz legacy antenna has a −3 to −6 db gain over a ¼ wave monopole. The 30 megahertz legacy antenna is typically a monopole antenna whose gain is directly proportional to antenna volume. It is noted that for 30 megahertz, a quarter wavelength is 8 feet which makes a quarter wave antenna unusable in a wide variety of applications.

What is therefore required in addition to multi-band operation is an antenna whose overall height is no more than 4 or 5 feet.

It would therefore be desirable for instance to be able to replace the army AS3900A whip antenna with a single relatively short multi-band whip antenna that could provide the requisite gain.

One antenna capable of multi-band use is described in U.S. patent application Ser. No. 11/641,041 assigned to the assignee hereof. This antenna is designed to operate in the 30 to 88 megahertz band. However it is over 105 inches tall. Another problem with this antenna is that it is fabricated utilizing a number of sections of tubing that are screwed together. It has been found that these antennas are not readily fabricatable and deployable in the field due to the variability when screwing the sections together and due to the fact that from a storage point of view a 105 inch antenna is not practical.

Thus, especially for the Sincgars radio band, providing such an antenna, primarily for voice communications, has its problems. Moreover, when considering vehicle mounted antennas operating above a ground plane, variability in the ground plane configuration causes matching and radiation pattern problems because vehicle configurations can vary significantly. It therefore becomes critical as where on the vehicle to mount the antenna.

While it might be thought that any antenna could be tuned for each vehicle, such antennas are not practical and the simple solution is to simply avoid frequencies where VSWR is high, with the obvious coverage disadvantages.

Moreover, aside from its length and multi-part construction, it was found that standard meanderlines used to separate out the bands did not adequately act as traps. Thus, while various dipoles were designed to operate in various bands, the traps did not function properly to switch from a short to a trap at the band demarcations.

Secondly, especially in the middle and upper bands, the prior antenna did not exhibit sufficient gain so that the antenna could not match or exceed legacy antennas.

Further, it was found that in shortening the prior antenna, linearly downsizing the meanderlines did not result in the either sufficient gain or sufficiently low VSWR.

Moreover, it was almost impossible to tune the meanderlines once in place. The result was that pre-tuned antennas would not exhibit the required tuning when vehicle mounted.

Finally, the antenna could not pass the so-called oak-beam test, in which the antenna is to withstand repeated impact with an oak beam at 30 mph.

For these reasons the antenna design described in the aforementioned patent applications had to be abandoned and a new antenna had to be designed that would solve the problems noted above.

Note, it has been proposed to miniaturize antennas by using so-called meanderline loaded antennas exemplified by U.S. Pat. Nos. 5,790,080; 6,323,814; 6,373,440; 6,373,446; 6,480,158; 6,492,953; and 6,404,391, all assigned to the assignee hereof and incorporated herein by reference. While these meanderlines have been utilized in the past for impendence matching and tuning purposes, they were not utilized to provide chokes or traps between various dipole segments so as to make a single whip operate in a multi-band mode.

By way of background, in order to solve the multiple antenna problems noted above, and as discussed in the aforementioned patent application, a series of dipoles are mounted one on top of the other in which the antenna consists of a number of coaxially-located tubular sections, with gaps in the tubing either providing feed points for the associated dipole or for the interposition of shielded meanderlines that properly perform as chokes or traps. As a result, as one moves up in frequency, one coverts the antenna structure from a 30-190 hertz dipole to a 225-240 megahertz dipole and then to a 700 megahertz to 2 gigahertz dipole, with the chokes or traps providing for the distinct antennas.

Moreover, in order to reduce the overall height from 105 inches to 5 ½ feet, rather than using traditional meanderlines, staggered shielded meanderlines are utilized to provide better choking or trap functions.

Specifically, it was found that one could not reduce the overall size of the multi-element antenna of Ser. No. 11/641,041 by simply scaling the meanderlines. Rather it was found that a stagger tuning arrangement for the meanderlines was needed that involved utilizing the lower meanderline in tact, but shortening the upper meanderline to approximately 70% of the size of the initially designed meanderline.

In particular, the effective length of the broadband whip antenna as a function of frequency is constructed to never exceed 1.2 wavelengths from 30 to 450 megahertz. This constraint guarantees there will always exist a main lobe on the horizon. In one embodiment, at 30 megahertz the effective antenna length is 62 inches, whereas from 240 to 450 megahertz the effective length is 22 inches.

The effective length condition is maintained by the use of folded or shielded meanderline structures inserted at strategic points along the whip. The folded meanderline structures approximate so called photonic band gap devices which are periodic resonant structures. Such devices have alternating band pass/band stop characteristics as a function of frequency. At about 220 MHz the meanderline transfer function enters the band stop region. A smooth transition in the 240 MHz region is accomplished by utilizing the above-mentioned stagger tuned meanderline structures.

More particularly, the meanderlines are two fold periodic. The only practical way to integrate the meanderlines on the antenna is to use a folded or shielded configuration. The periodic meanderlines must have identical folds to achieve the ideal transfer function. Because the folds are stacked one above the other, the inner fold sees the shielding effect of the outer fold. This shielding effect causes the inner fold to have more delay than the outer fold. For optimum performance the two folds should have the same delay. Thus, the inner fold must be physically shortened.

As to meanderline impedance, the impedance across the respective meanderlines is such that the upper meanderline choke response is shifted to higher frequencies because of the shorter length.

At lower frequencies both lines act as shorts and have zero impedance, while at high frequencies the impedance of both meanderlines is high to achieve the trap or choke function.

At about 230 megahertz the lower meanderline starts to act as a choke while the upper meanderline is at a low impedance, i.e. forms a short. Under this condition the antenna acts like a asymmetrical dipole from the lower meanderline to the top of the antenna.

At about 280 megahertz the upper meanderline starts to act as a choke such that both meanderlines act as chokes. Under this condition the antenna acts like a asymmetrical dipole between the two meanderlines.

If the meanderlines are the same length, the transition from a full antenna to an abbreviated antenna leads to Gibbs oscillations in the antenna gain.

The above staggered configuration solves this problem by being asymmetric as an intermediate state so that the transition from a full antenna to an abbreviated antenna is more gradual, mitigating the oscillation problem.

Additionally, at the low end of the 30 megahertz band a tuning sleeve is positioned between the base of the lowest element and the ground plane, with the tuning sleeve being provided with two parallel RLC circuits tuned to different bands. The purpose of the sleeve with the RLC circuits is to eliminate an unwanted null and provide low VSWR at the low end of the VHF band.

Moreover, it was found that a parasitic re-radiator can be formed at the top of the 225-450 MHz dipole to provide improved gain especially for the upper region of the UHF band.

What is therefore made possible by the above improvements to the originally designed vehicular multi-band antenna of U.S. patent application Ser. No. 11/641,045 is that the antenna itself is of a unitary construction in which the cylindrical elements of the dipoles are stacked one on top of the other without having to screw together antenna segments.

Secondly, the overall height of the antenna is reduced from 105 inches to 66 inches which is ⅔rds of the height of the originally designed antenna.

Fourthly, staggered shielded meanderlines permit antenna shortening without unwanted oscillations.

Thirdly, shielded meanderlines provide effective chokes or traps, where unshielded meanderlines failed.

Additionally, the utilization of a base tuning sleeve results in a better VSWR at the low end of 30 megahertz band.

In operation, from 30 to 190 megahertz a center-fed dipole is made up of 4 cylindrical elements, one on top of the other. In this case the shielded meanderline chokes act as shorts between the lower two and the upper two dipole elements to provide a long dipole.

As one precedes above 190 megahertz the two shielded meanderlines, rather than performing a shorting function, transition to open at these frequencies resulting in a shorter dipole antenna operating at 225-450 megahertz. Here the antenna only utilizes the center two elements of the 30-190 megahertz dipole. Over 450 megahertz the four tubular antenna elements previously described have virtually no effect on a top mounted dipole operating between 700 megahertz and 2 gigahertz.

Thus the antenna has three in-line dipoles, with the lower band dipole consisting of four elements, pairs of which being electrically shorted together to form the 30 MHz to 190 MHz dipole. Thereafter, the center elements of this dipole are the only ones that are active in the 225 to 450 megahertz band, with the other elements electrically open with respect to this dipole.

Finally, all of the above mentioned elements are electrically isolated from a top 700 megahertz to a 2 gigahertz dipole. Note all the antenna elements are in-line and coaxially aligned in a single vertically stacked package, with the tubular elements surrounded in one embodiment by wrapped fiber glass. It has also been found that an intermediate fiber glass wrapping layer with overlying copper tape may be conveniently utilized to tune the dipoles for each vehicle mounting scenario. Moreover, a ground plane like sleeve may be placed over the intermediate fiberglass layer below the L-band dipole to reflect the L-band beam upward.

In summary, a shortened multi-band antenna includes in-line dipoles, selected elements of which having shielded meanderline chokes to be able to switch from an extended dipole at the lower VHF frequencies to a shortened dipole for the UHF band. Additionally, the staggered asymmetric meanderline configuration permits overall size reduction, whereas antenna construction includes an intermediate fiberglass layer over which conductive foil is placed for tuning and for parasitic radiator purposes to improve the gain of the UHF dipole in the upper regions of the band at 450 megahertz. Additionally, at the low end of the 30 megahertz band a sleeve is positioned between the base of the lowest dipole element and ground, with the sleeve provided with two parallel RLC circuits tuned to different bands to improve VSWR at the low end of the VHF band and to eliminate unwanted nulls.

Regardless of the design of the Broadband Whip Antenna of patent application Ser. No. 12/436,375, improvements are still required to obtain continuous coverage up to 6 GHz while at the same time reducing nulls in the far field and improving VSWR across some troublesome bands.

It is noted that continuous operation up to 6 GHz is highly desirable because of the existence of WiFi bands from 5.5 to 5.75 (GHz as well as the 2.8 and 2.5 GHz WiFi hands. A simple whip antenna to cover all WiFi bands permits detection of WiFi transmissions as well as the ability to jam them from a vehicle, vessel or aircraft.

SUMMARY OF INVENTION

The improvements to the broadband communication antenna described above involve first, extending continuous coverage to 6 GHz using the same whip configuration by eliminating nulls between 3.5 GHz and 6.0 GHz in the far field antenna pattern and improving VSWR. This is accomplished by using an elongated tuning sleeve over the L-band feedpoint in which the elongated tuning sleeve is resonant at one half the wavelength associated with 5 GHz such that all currents at the feedpoint including the deleterious reverse-polarity current are canceled. Secondly, below 3.5 GHz nulls are eliminated by using chokes at the ends of the L-band antenna to effectively shorten the antenna so as to permit reverse polarity currents at the L-band antenna feedpoint which also improves VSWR, with the chokes cut to resonate at one half the wavelength associated with 2.7 GHz. Thirdly, 410-512 MHz performance is improved by using double shielded meanderlines in which a mirror image of one shielded meanderline is located side-by-side with the original shielded meanderline. Fourthly, 512-700 MHz performance is improved by adding capacitance at the bottom of the U-band antenna to effectively elongate the antenna so that the antenna resonates below 700 MHz.

In summary, a multi-band whip antenna having a 30 MHz to 2 GHz bandwidth and an L-band dipole has its coverage extended up to 6 GHz by eliminating nulls and reducing VSWR problems that are cured through the utilization of a sleeve over the feedpoint of the L-band antenna. Chokes in the form of sleeves are provided at either end of the L-band dipole to shorten the L-band antenna for preventing reverse polarity currents at the L-band antenna feedpoint, with the antenna further including the use of double shielded meanderlines to provide improved performance between 410-512 MHz and in which a capacitance sleeve is added at the bottom of the L-band antenna to effectively elongate the antenna below the L-band to permit operation below 700 MHz.

BRIEF DESCRIPTION OF THE DRAWINGS

These and other features of the subject invention will be better understood in connection with the Detailed Description, in conjunction with the Drawings, of which.

DETAILED DESCRIPTION

Figure 1:
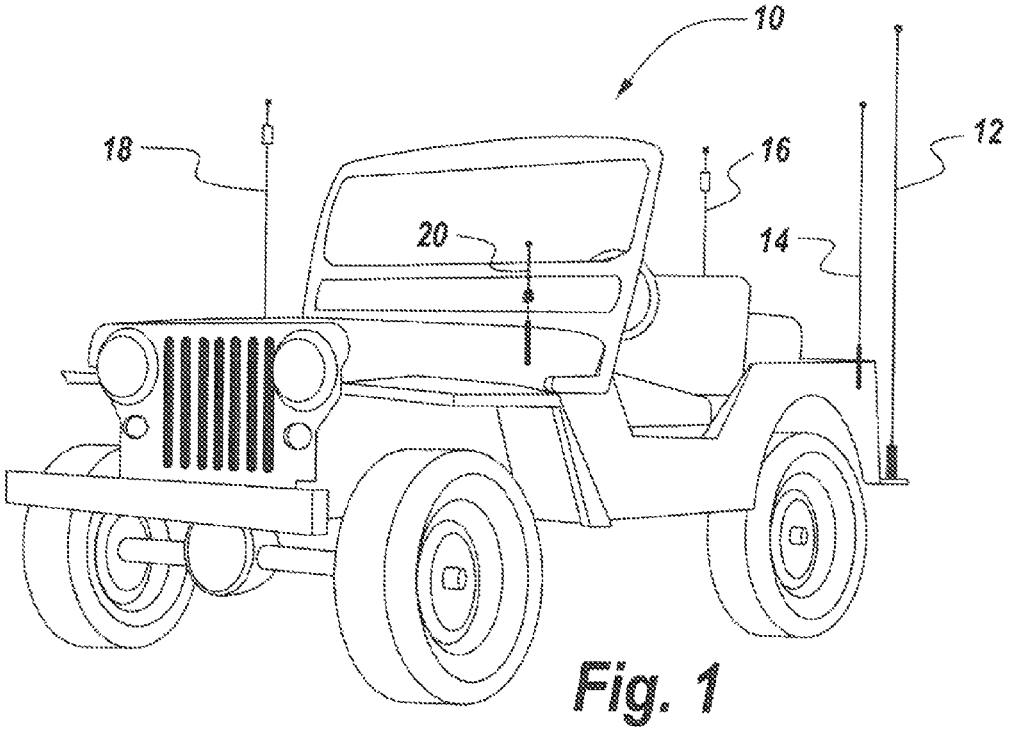
Fig. 1 Prior Art
FIG. 1 is a diagrammatic illustration of prior art antenna vehicle mounting in which a virtual forest of antennas is provided on the vehicle to provide appropriate multi-band coverage.

Referring now to FIG. 1, in the prior art, a vehicle 10 is normally provided with a number of antennas 12-20 tuned to various bands. The fact of having to provide a vehicle with such a large number of antennas for multi-band coverage is problematical and it had been proposed to have an elongated whip, here shown as monopole 12, loaded up to accommodate various bands.

However, the length of the whip as well as the inefficiencies of providing such a wideband bottom-loaded whip had led to the development of the multi-band antenna described above. This multi-band antenna also had deficiencies which resulted in the development of the shortened whip antenna shown in FIG. 2 over which the below described improvements apply.

The Original Whip Antenna

Figure 2:
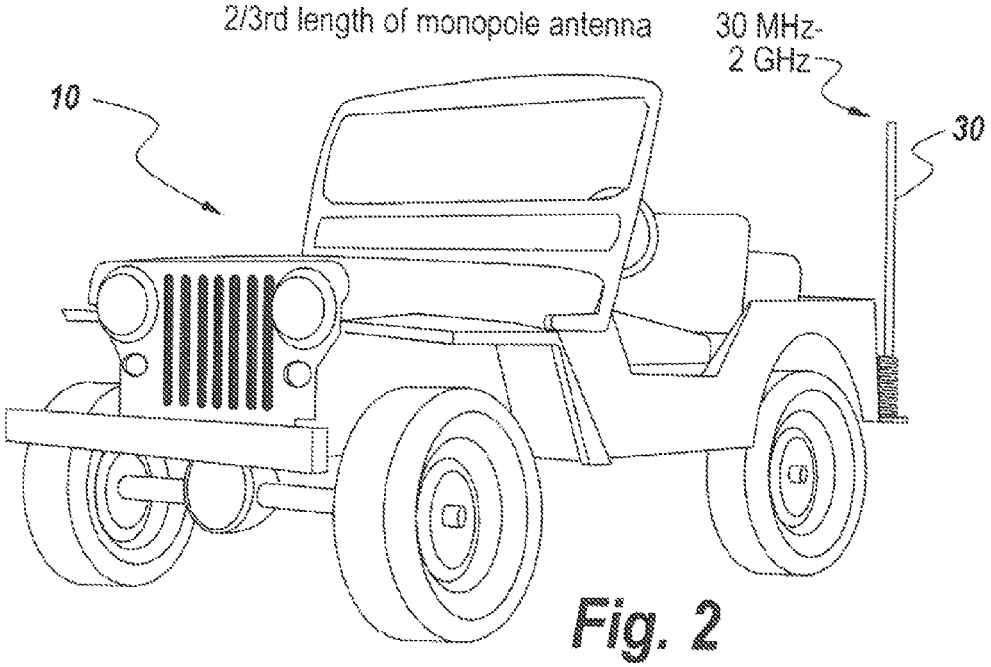
FIG. 2 is a diagrammatic illustration of a whip antenna which is two-thirds the length of the monopole antenna of FIG. 1 and operates between 30 megahertz and 2 gigahertz to provide multi-band coverage.

As can be seen in FIG. 2, an antenna 30 is mounted to a vehicle 10 in which the overall length of the antenna is ⅔rds of the length of the prior multi-band antenna described in the above patent applications. The coverage of the subject antenna is from 30 megahertz to 2 gigahertz. Note that this antenna is in the form of a single, unitary, relatively short whip for multi-band communications across a wide frequency spectrum.

Figure 3:
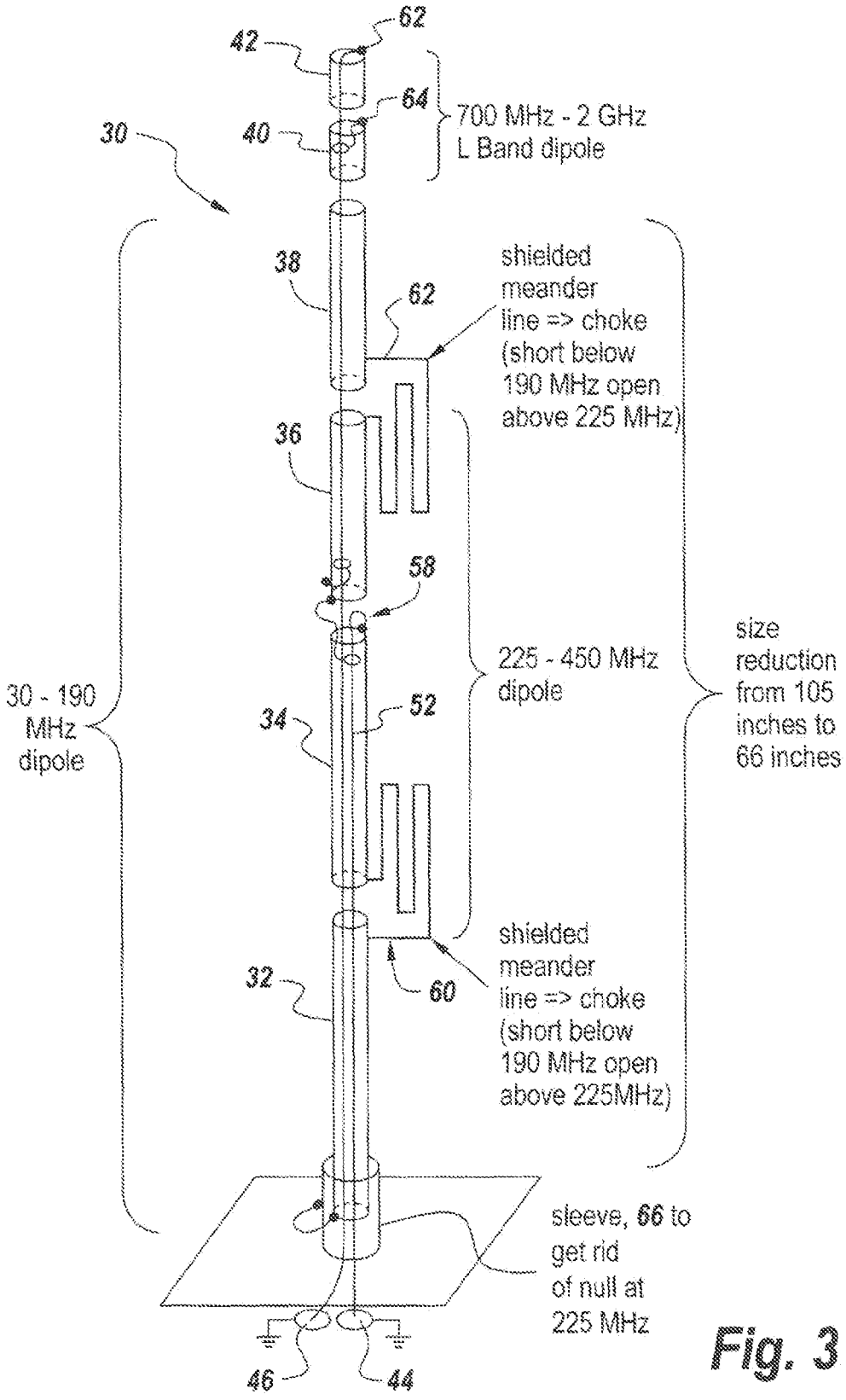
FIG. 3 is a diagrammatic illustration of the antenna of FIG. 2 in which in-line dipole elements are located one on top of the other above a ground plane in which the center two elements are connected to adjacent outboard elements with shielded meanderlines to provide a choke or trap function such that the center two elements form a 225-450 megahertz dipole, with the four elements providing a 30-190 megahertz dipole when the shielded meanderlines act as shorts, also showing an L-band dipole located in-line above the other dipole elements.

As shown in FIG. 3, antenna 30 is made up of in-line dipole elements or radiators 32, 34, 36, 38, 40 and 42 which are driven at feed points 44 and 46 to provide the indicated coverage.

As indicated, a shortened dipole is composed of dipole elements 34 and 36 fed at feed point 50, with the center conductor 52 of a coaxial feed line being coupled to element 34, whereas the ground for this coax is coupled to element 36.

In order to provide a dipole antenna operable from 30 megahertz to 190 megahertz, elements 32 and 38 are shorted to respective adjacent elements 34 and 36 utilizing a shielded meanderline system. At these frequencies, the shielded meanderline 60 shorts element 32 to element 34, whereas shielded meanderline 62 shorts element 36 to element 38. This provides an elongated dipole over 30-190 MHz. Note that the shielded meanderlines are designed to form a short below 190 megahertz, whereas at the lower meanderline starts to go open above 225 megahertz. At this time the upper meanderline functions as a short. This results in an asymmetrically fed dipole, with elements 32, 34 and 36 having an effective length to cover a 225-280 MHz frequency range. Thereafter, upper meanderline 62, being shorter than the lower meanderline, opens up so that the dipole corresponds to elements 34 and 36 to cover 280 MHz to 450 MHz. Note at this time the dipole is a symmetrically fed dipole.

This staggered meanderline tuning eliminates Gibbs oscillations and makes possible shortening of the antenna. Thus, the action of the meanderlines is to shorten the elongated VHF band dipole for frequencies above 225 MHz.

It will be seen that four in-line dipoles elements are coaxially located and stacked one on top of another, with the shielded meanderline chokes providing the switching between an elongated dipole and foreshortened dipoles.

Also shown is an in-line L-band 700 megahertz-2 gigahertz dipole antenna having elements 40 and 42. This dipole is fed by coax which runs up through elements 32-38 and has its center connector 62 coupled to element 42, whereas its ground shield 64 is coupled to element 40.

As will be discussed, the subject design results in a size reduction from 105 inches which was the length of the prior multi-band antenna to 66 inches due to the shielded meanderline structure and more particularly to the staggered asymmetrical meanderline configuration.

Also shown in this figure is a sleeve 66 to eliminate a null at 225 megahertz and to improve to VSWR at the low end of the 30 megahertz band. The construction of the sleeve will also be discussed hereinafter.

Figure 4:
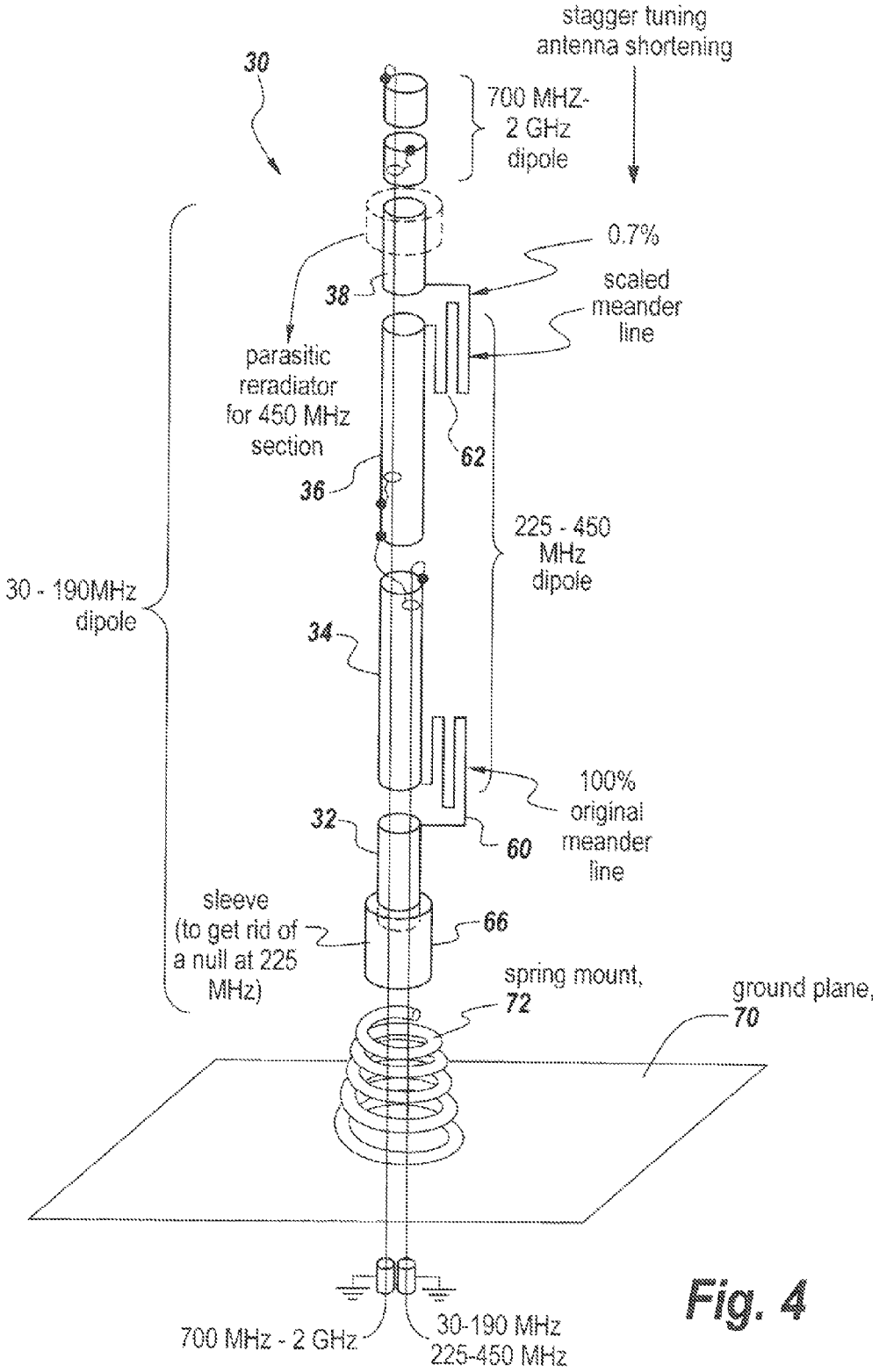
FIG. 4 is a diagrammatic illustration of the antenna of FIG. 3 showing the staggered meanderline structure.

Referring now to FIG. 4, in which like elements carry like reference characters, it can be seen that antenna 30 is located above a ground plane 70, i.e. the vehicle body, and is spring mounted as illustrated at 72.

Also shown in this figure is a parasitic re-radiator for the 450 megahertz section of this antenna, namely section 38. This parasitic element is a cylindrical foil spaced from and wrapped around the distal end of element 38. The purpose of this parasitic re-radiator is to provide improved gain at the upper end of the UHF band namely at around 450 megahertz.

Central to the ability to shorten the prior 105 inch antenna is the use of so-called scaled meanderlines in a stagger tuning arrangement whereby meanderline 60 is the same size as its original design, but meanderline 62 is scaled to approximately 70% of its originally-designed size. This shifts its choke frequency upward to approximately 280 MHz.

It is noted that the effective length of the subject broadband antenna as a function of frequency is constrained to never exceed 1.2 wavelengths from 30 to 450 megahertz. This constraint guarantees that there will always exist a main lobe on the horizon.

Figure 8:
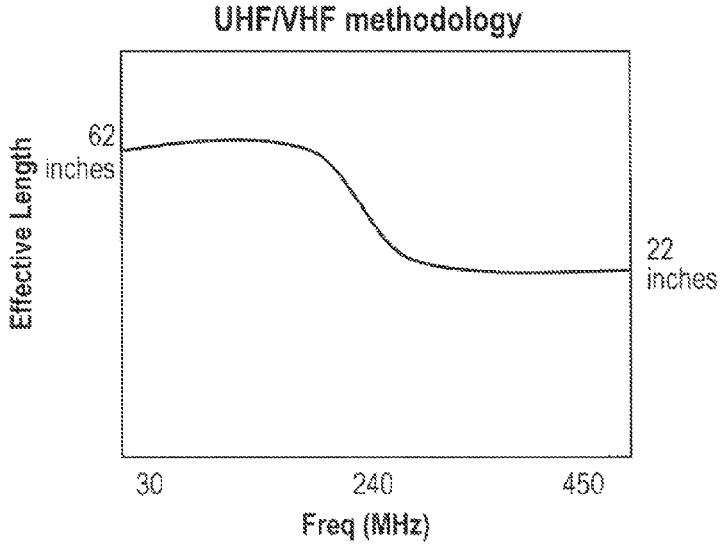
FIG. 8 is a graph of effective antenna length versus frequency showing a gentle, effective length transfer from 62 inches to 22 inches about the 240 megahertz frequency.

As seen in FIG. 8, the effective length of the subject antenna varies from approximately 62 inches at frequencies from 30 megahertz to 225 megahertz and goes down to 22 inches for frequencies at or above 280 megahertz.

The above-noted effective length is maintained by use of folded meanderline structures inserted at strategic points along the antenna. The folded meanderline structures approximate photonic band gap devices which are periodic resonant structures. Such devices have alternating band pass/band stop characteristics as a function of frequency. At about 225 megahertz the meanderline transfer function of the lower meanderline enters the band stop region from an essentially shorting condition. The smooth transition in the 240 megahertz region is accomplished by utilizing the above-mentioned stagger tuned meanderline structures, with the stagger tuning offering the smooth transition function and preventing oscillations.

As can be seen, the meanderlines are two-told periodic. The only practical way to integrate the meanderlines on the whip is to use a folded configuration. The periodic meanderlines must have identical folds to achieve the ideal transfer function. Because the folds are stacked one above the other, the inner fold sees the shielding effect of the outer fold. This shielding effect causes the inner fold to have more delay than the outer fold. For optimum performance the two folds should have the same delay. Thus, the inner fold must be physically shortened as illustrated.

Figure 6:
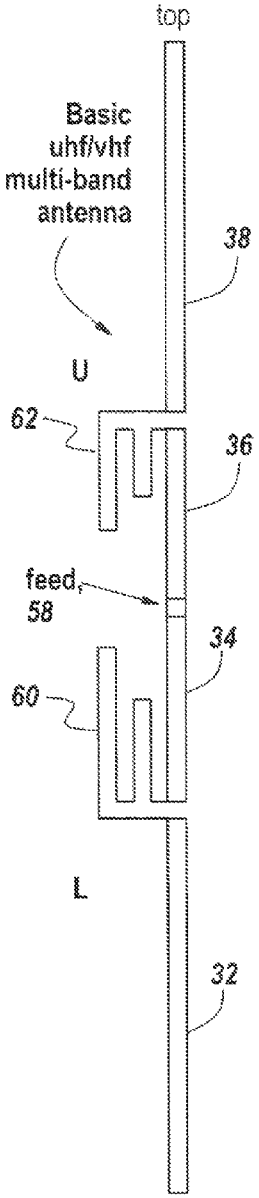
FIG. 6 is a schematic diagram of the basic UHF/VHF multi-band antenna showing the placement of the shielded meanderlines between adjacent dipole elements.

Referring now to FIG. 6, the two meanderlines 60 and 62 are shown bridging elements 32 and 34, and 36 and 38 respectively. Meanderline 60 is labeled L for the lower meanderline, whereas meanderline 62 is labeled U for the upper meanderline. The feed point 50 is as noted.

Figure 7:
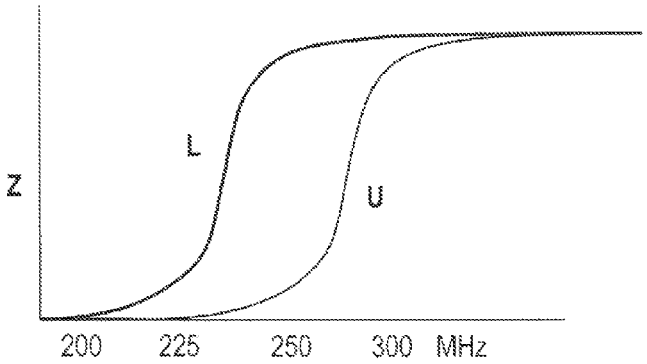
FIG. 7 is a graph of impedance versus frequency for the shielded meanderline chokes of FIG. 6.

Referring to FIG. 7 when impedance Z is graphed against frequency for these two meanderlines, the upper meanderline's choke response is shifted to higher frequencies because of the shorter length. At lower frequencies both the lower and upper have zero impedance, Z, while at higher frequencies the impendence is high. It will be noted that as can be seen in FIG. 6 meanderline 60 is longer than meanderline 62.

In operation, at about 225 megahertz the lower meanderline goes from a short to a choke, while the upper meanderline is still in a low impedance short condition. Under this condition the multi-band antenna acts like an asymmetrically fed dipole from the lower meanderline to the top of the VHF/UHF antenna.

At about 280 megahertz the upper meanderline stops conducting, making both the upper and lower meanderlines function as chokes. Under this condition the antenna acts like a shortened symmetric dipole between the upper and lower meanderlines.

If the upper and lower meanderlines are the same length, the transition from full antenna length to abbreviated antenna length is abrupt, leading to Gibbs oscillations in the antenna gain.

However the staggered configuration exhibits the asymmetric case as an intermediate state, so that the transition from a full length antenna to an abbreviated length antenna is more gradual, mitigating the oscillation problem.

Thus as can be seen from FIG. 7, the lower meanderline starts to become a choke at about 225 MHz, whereas the upper meanderline being shorter, provides a choking or trap action at about 280 megahertz.

Put another way, the lower meanderline acts as a short below 225 megahertz as does the upper meanderline. However the lower meanderline starts to exhibit a choke or trap function at or about 225 megahertz presenting a virtual open circuit between elements 32 and 34. At this time however, the upper meanderline still functions as a short. At or about 280 megahertz the upper meanderline starts to act as an open or function as a choke, whereas both meanderlines at or above this 280 megahertz region act to disconnect the elements 32 and 38 from adjacent dipole components to form the shortened dipole.

Figure 5:
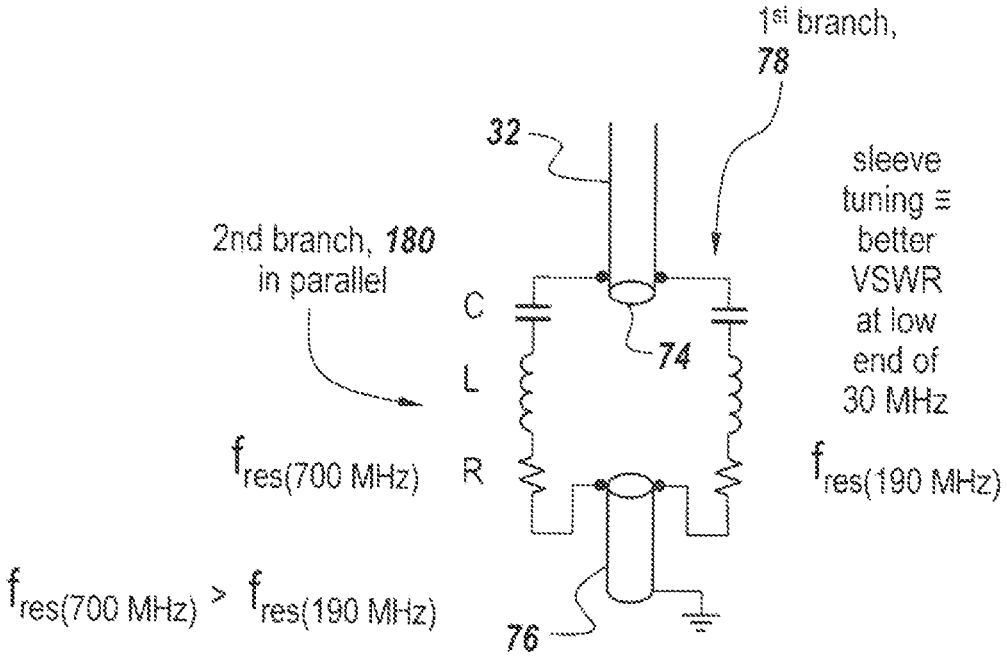
FIG. 5 is a schematic diagram of the base sleeve which can incorporate parallel RLC circuits tuned to different frequencies for improving VSWR at the low end of the 30 megahertz band.

Referring back to FIGS. 3, 4 and 5, as can be seen from the schematic diagram, the sleeve has two internal RLC circuits which are connected in parallel between an end 74 of element 32 and a ferrule grounded at 76.

Here it can be seen that the RLC circuit of the first branch 78 is resonant at about 190 megahertz, whereas the resonant frequency of the second branch 80 in parallel with the first branch is at about 100 megahertz.

The purpose of these two parallel RLC circuits and the tuning sleeve is to achieve better VSWR at the low end of the 30 megahertz band and also to eliminate the nulls at 225 megahertz that were found to exist.

Figure 9:
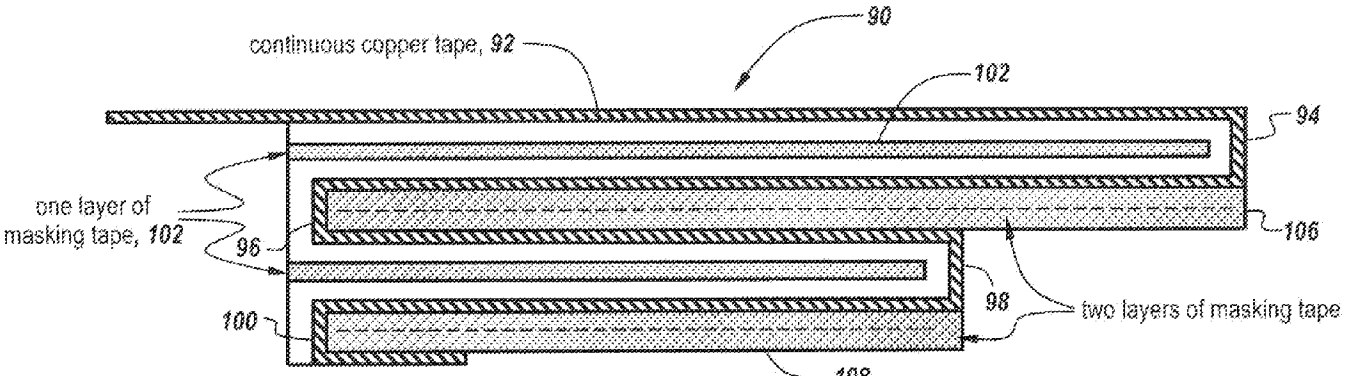
FIG. 9 is a diagrammatic illustration of the construction of the shielded meanderlines including a continuous copper tape snaked back and forth with layers of masking tape between the folds.

Referring now to FIG. 9 and more particularly to the construction of this shielded meanderline structure, what is seen here is a meanderline 90 that is formed of a continuous flaked tape 92 which is folded on itself at a fold 94, again at 96, again at 98 and finally at 100, with the copper tape being insulated from adjacent folds through the utilization of masking tape. In one embodiment, a single layer of masking tape 102 is used between the top folded layers, whereas the same single layer is also used as shown at 104 between the bottom folded layers.

A double layer of masking tape is shown to insulate the meanderline material adjacent folds 96 and 100 from each other. This structure thus provides a relatively thin structure which when placed adjacent respective dipole elements does not protrude out significantly or bulge.

Referring now to FIGS. 10-14, one method of manufacturing the subject antenna starts with the utilization of an internal tube assembly here illustrated at 120. Note that there are two coax feed lines that make up the feed of the antenna and are internal to the internal tube assembly. The outer jackets of the two coax lines are shorted together at the base of the antenna and their other connections are clearly shown in FIG. 3. It is noted that the internal fed is carefully fed through the internal tube assembly. Thereafter, the VHF/UHF and L-band feeds are prepared for their respective radiators in this assembly step. Thereafter, they are attached to their respective radiators.

In one embodiment, the VHF/UHF coax extends approximately half way up the internal tube assembly structure and feeds the VHF/UHF radiator through a small hole in the fiberglass tube. Thereafter the center conductor of the VHF/UHF coax is prepared and is attached to the bottom section of the VHF/UHF radiator. Thus, the outer conductor is prepared and is attached to the top section of the VHF/UHF radiator. This fee ding scheme is known as the reverse feed approach and is unique to the subject invention.

The L-band coax extends beyond the VHF/UHF coax and feeds the L-band radiator through a hole in the L-band radiator internal tube assembly 122.

It will be seen that in order to provide the VHF/UHF radiator with the proper length, a brass tube 124 is attached to internal tube assembly 120 which as will be seen is to be connected to the foil wraps that form the upper dipole radiator. As can be seen, the outer conductor of the L-band coax is shorted to the brass tube via a short length of copper braid. This short is realized through a hole in the brass tube that occurs below the top of the brass tube Referring now to FIG. 11, dipole radiator elements 32, 34, 36 and 38 in one embodiment, are made by wrapping foil around internal tube 120; and meanderlines 126 and 128 are attached between the indicated adjacent radiator elements. It will be appreciated that element 38 is electrically attached to brass tube 124 via solder or shorting link as illustrated at 132 to provide this required dipole element length. Otherwise, in another embodiment, the brass tube is not used and element 38 is extended over an extended internal tube.

Also shown is the L-band dipole composed of elements 128 and 130 mounted to internal tube 122.

Figure 12:
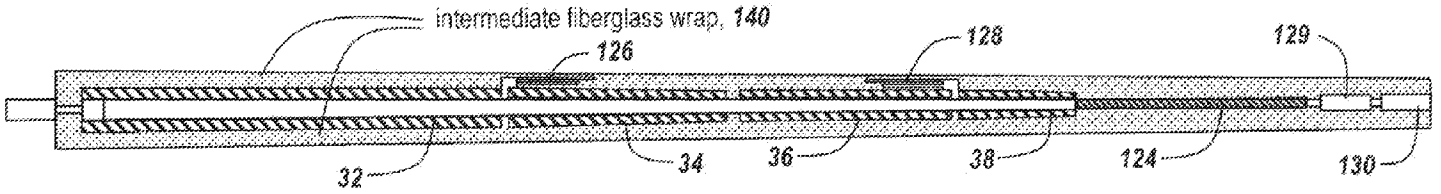
FIG. 12 is a diagrammatic illustration of the antenna of FIG. 11, illustrating the overlying of the dipole elements and the meanderlines with an intermediate fiberglass wrap.
Figure 13:
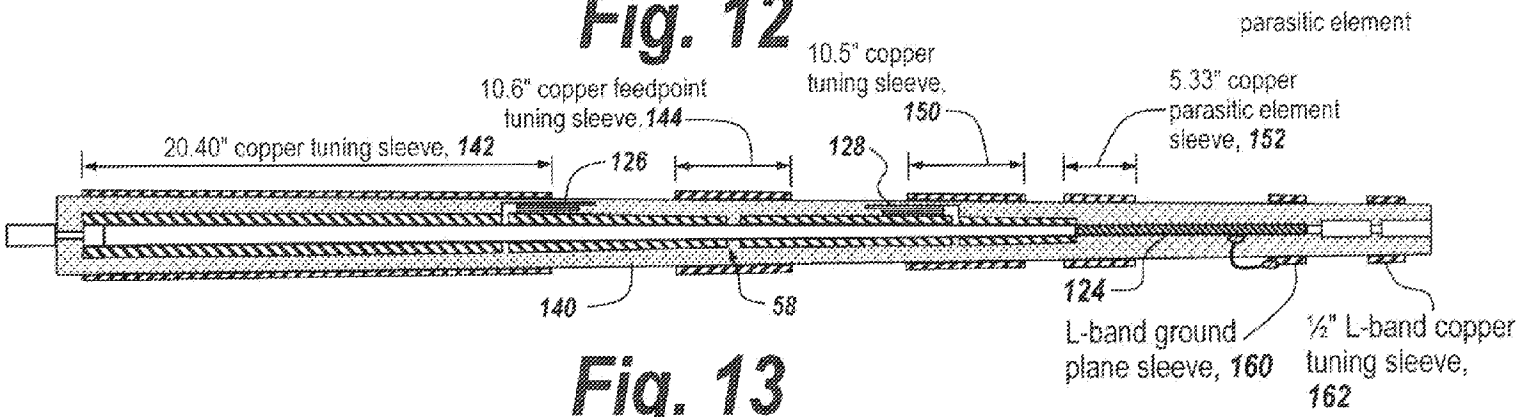
FIG. 13 is a diagrammatic illustration of the antenna of FIG. 12, illustrating the utilization of copper tuning sleeves over meanderline elements, and the VHF/UHF feed point, also showing a parasitic element sleeve placed on top of the intermediate fiberglass wrap for improving the upper end gain of the UHF dipole.

Referring now to FIG. 12, an intermediate fiberglass wrap 140 surrounds all of the elements described above and as shown in FIG. 13 an elongated copper tuning sleeve overlies the intermediate wrap 140 above meanderline 126. A copper feed point tuning sleeve 144 overlies feed point 58, whereas copper tuning sleeve 146 overlies meanderline 128.

Finally, a parasitic element can be provided by a parasitic element sleeve 152 which surrounds a portion of the upper element of the VHF/UHF antenna.

Moreover, with respect to the L-band antenna, it is possible to overlie the intermediate fiberglass layer with an L-band ground plane sleeve 160 below the L-band antenna that serves to angle the beam from the L-band antenna in an upward direction. Additionally, it is possible to provide the L-band antenna with an L-band copper tuning sleeve 162 for tuning the feed point in the same way that copper feed point tuning sleeve 144 is used to tune the feed point of the VHF/UHF dipole.

Figure 14:
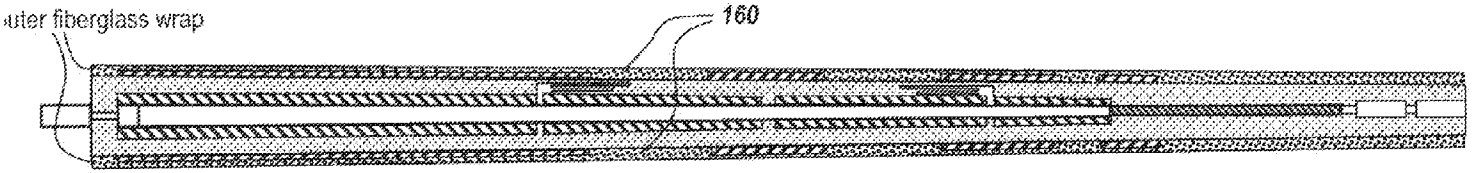
FIG. 14 is a diagrammatic illustration of the antenna of FIG. 14, showing the over-wrapping of the entire structure of FIG. 13 with an outer fiberglass wrap.

It is a feature of these overlaying sleeves that they can be formed by wrapping copper foil or tape around the intermediate fiberglass wrap and can be used to tune the various elements of the antenna in a convenient way prior to applying an outer fiberglass wrap 160 as illustrated in FIG. 14 to complete this antenna.

The above construction method provides an extremely robust antenna capable of surviving the oak-beam test, and is easily tunable through the utilization of the sleeves wrapped about the intermediate fiberglass wrap.

Improvements

FIGS. 15-28 are now used to describe the four improvements mentioned hereinabove to the whip antenna described m FIGS. 2-14. It will be appreciated that the whip antenna described in these figures relates to a whip antenna that has a frequency range between 27 MHz and 2 GHz. As mentioned, it is desirable to extend the operating range of such a whip antenna to include up to 6 GHz which, inter alia, includes being able to detect WiFi emissions above 2 GHz and to be able to provide effective jamming signals in this frequency range.

In order to increase the upper frequency limit of the whip antenna one needs to understand that there are several impediments to the use of the antenna of FIGS. 2-14 to operate up to 6 GHz.

Figure 15:
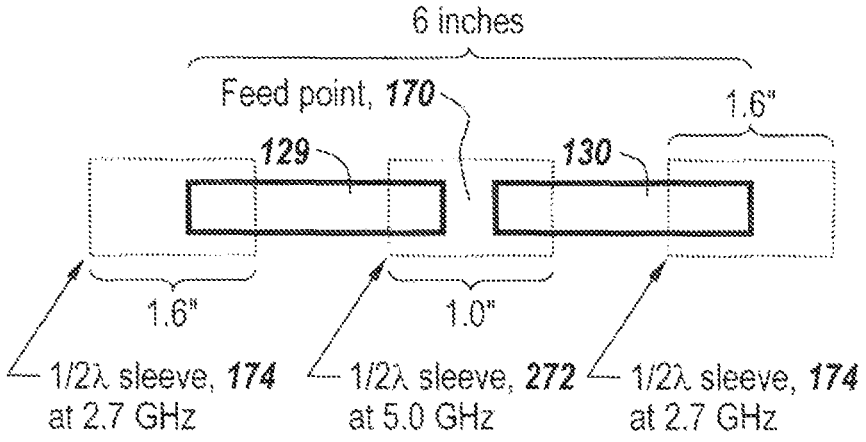
FIG. 15 is a diagrammatic illustration of the L-band section of the subject antenna showing an elongated sleeve at the feedpoint of the antenna and sleeves at the distal ends of the dipole forming the L-band antenna that serve as chokes.

To enable operation up to 6 GHz, in FIG. 15 additional sleeves are provided that are positioned over L-band dipole elements 129 and 130. These sleeves are utilized to eliminate 180 phase reversal of antenna current at the feedpoint 170 of the L-band antenna.

In general, the L-band antenna as illustrated is approximately 6 inches in length, with the feedpoint 170 being overlain with a one half wavelength sleeve 172 at 5 GHz. This involves elongating the original one half inch sleeve that was used for tuning the original L-band antenna.

3.5 MHz-6 GHz

As will be discussed, above 3.5 MHz this elongated tuning sleeve eliminates nulls and provides appropriate performance from 3.5 GHz to 5 GHz. This is done by eliminating all currents including out-of-phase currents at the feedpoint of the antenna. Having out-of-phase currents at the feedpoint causes two things. First there are nulls at various frequencies in the far field antenna pattern. Secondly, having out-of-phase current at the antenna feedpoint causes the antenna input impedance to go up from a nominal 50 ohms to several hundred ohms which causes the VSWR to go up.

2.0-3.5 GHz

Below 3.5 GHz nulls and high VSWR are also problematic. To solve these problems, sleeves 174 are positioned at either end of the L-band dipole antenna and when configured to resonate at 2.7 GHz eliminate the 180° phase-reversed current at feedpoint 170 to eliminate nulls between 2 GHz and 3.5 GHz. The reduction of the nulls in the far field also reduces the SWR between 2 GHz and 3.5 GHz so that in terms of 2 GHz and above, the SWR of the improved antenna described in FIGS. 15-28 is less than 2:1, and ideally 1.3:1.

Figure 16:
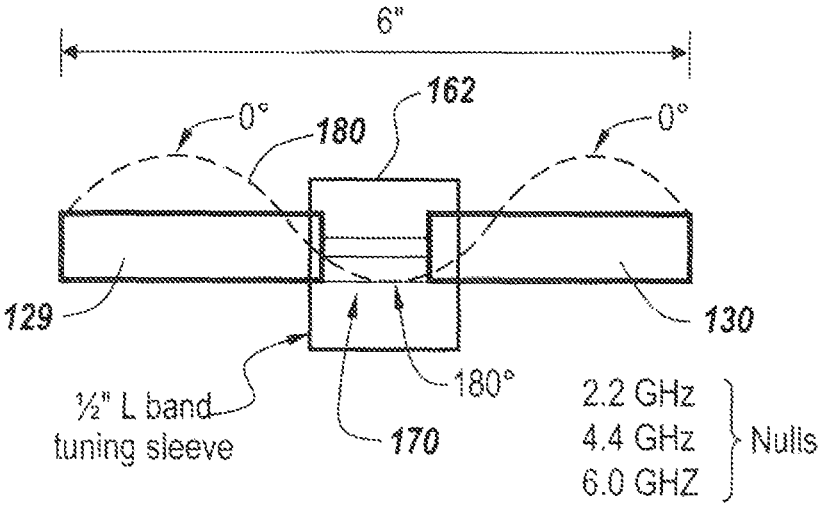
FIG. 16 is a diagrammatic illustration of the current distribution across the antenna of FIG. 15 when utilizing a one half inch L-band tuning sleeve in which a 180° phase reversal causes far field nulls at 2.2 GHz, 4.4 GHz, and 6 GHz.

More particularly, and referring to FIG. 16, the original tuning sleeve 162 was configured to a length of one half inch. The result, however, of trying to tune the L-band antenna comprising dipole elements 129 and 130 using a one half inch sleeve was that far field nulls occurred at 2.2 GHz, 4.4 GHz and 6.0 GHz. The reason for this as can be seen by the dotted line 180 corresponding to the current about a feedpoint 170 in that positive going excursions of the current, here characterized by a phase of 0°, occur to the right and left of the feedpoint. However, a phase-reversed 180° portion occurs at the feedpoint of the L-band antenna. The result of this phase-reversed current at the feedpoint is the major contributing factor to the aforementioned nulls.

Figure 17:
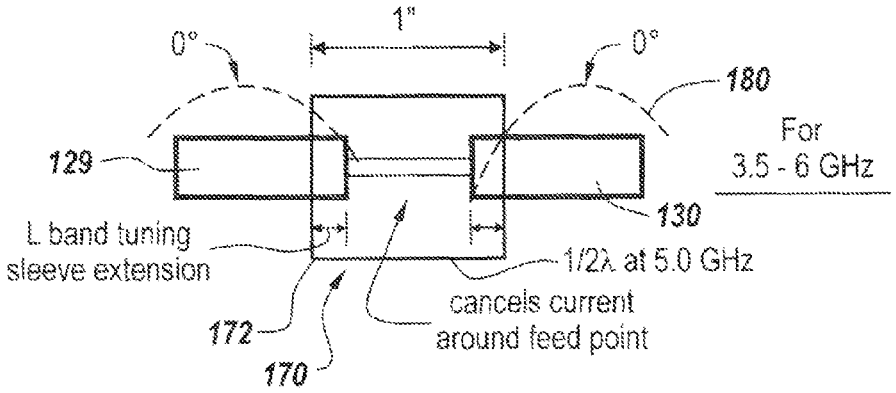
FIG. 17 is a diagrammatic illustration of the L-band antenna of FIG. 16 illustrating the utilization of an extended tuning sleeve resonating at a half wavelength at 5.0 GHz which cancels the phased reversed current around the feedpoint, thereby eliminating the nulls.

Referring to FIG. 17, for between 3.5 and 6 GHz, with an expanded tuning sleeve 172 configured to resonate at a half wavelength at 5 GHz all feedpoint current including phase-reversed portion of dotted line 180 is reduced to zero. This in turn eliminates the far field nulls and improves VSWR.

Note that the original L-band tuning sleeve was strictly for matching purposes to increase the capacitance around the feedpoint so that one could achieve a good VSWR. Note, a VSWR spike was found to exist at about 1.3 GHz and 1.32 GHz. These spikes below 2 GHz were in fact reduced by the one half inch tuning sleeve. However, this did not take care of nulls and VSWR spikes above 2 GHz.

The problem with the above was that without shortening the antenna it was difficult to operate the antenna above 2 GHz. The reason that the antenna would not operate properly at 6 GHz has to do with the length of the antenna. It turned out that the original length of the antenna is such that above 2 GHz there are nulls at 2.2 GHz, 4.4 GHz and 6.6 GHz due to phase-reversed feedpoint currents found to exist.

It will be appreciated that if one sought to operate in the 6 GHz band one would ordinarily shorten the L-band antenna. However, if one shortens the L-band antenna one cannot go down to the low end of the band, making the antenna performance below 2 to 3 GHz questionable.

In order to solve the problem of utilizing the original antenna, unaltered in length, it has been found that one can limit the out-of-phase current distribution at the L-band antenna feedpoint and thus constrain the current distribution along the antenna.

One has to change the current distribution above 2 GHz so that one can eliminate the nulls. Note the nulls at 2.2, 4.4 and 6.6 are severe, with the null at 6.6 starting to affect the antenna at 6.0 GHz. It is noted that these nulls significantly reduce antenna gain in the null direction.

With nulls one has zero gain on the horizon that affects a band of frequencies around 2.2, 4.4 and 6.6 GHz. Thus at these frequencies there are nulls in the horizontal antenna pattern. It turns out that the VSWR at the nulls is high due to high impedances at the antenna feedpoint created by the 180° phase-reversed current at the feedpoint. Thus, by solving the null problem one also solves the VSWR problem. At the particular frequencies where the nulls occur, the VSWR can go up to 4:1, whereas the desired VSWR is below 3:1.

As noted above for 3.5-6 GHz, by utilizing the extended tuning sleeve one can cancel the current around the feedpoint so that between 3.5 GHz and 6 GHz both nulls are eliminated and the VSWR is greatly reduced.

Since the original tuning sleeve was approximately one half inch, by extending it to one inch, this corresponds to a half wavelength at 5 GHz. What happens is that currents get excited within the sleeve and tend to cancel each other out around the feedpoint. Thus, the expanded sleeve acts as a suppressor of total current around the feedpoint. When one reduces the current around the feedpoint one does not have any reversals of current from 3.5 GHz-6 GHz that cause nulls on the horizon.

As to 2.0 GHz-3.5 GHz, the situation below 3.5 GHz are shown in FIG. 18 where again dotted line 180 shows a phase reversal of 180° at feedpoint 170.

The problems below 3.5 GHz are particularly severe around 2.2 GHz. Two additional sleeves are therefore added as illustrated at 174 that are 1.6 inches in length. This means that each resonates at one half wavelength at 2.7 GHz.

The purpose of these sleeves is to choke off the currents at frequencies below 3.5 GHz such that the antenna looks shorter. The result of a shorter antenna is that there is no phase reversal at the feedpoint so that the current distribution over the antenna is as illustrated by dotted line 182.

Current distribution 182 is the current distribution that occurs across the L-band antenna between 2 and 3.5 GHz. Since the sleeves choke off the currents that would normally appear on the ends of the elements, this dramatically reduces the reversal in current at the feedpoint so that it prevents any phase-reversed current 184, with little or no phase-reversed current there are no more nulls at 2.2 GHz. Note also that by choking off the current at the ends of the antenna, the current distribution 182 looks like that associated with a hall wave dipole at the center and tends to be in phase along the entire length of the antenna. Because one does not have current reversals, even though there is a slight dip at 186, one also does not have any discontinuities in the VSWR and, again, no nulls.

Thus by elongating the shield at the feedpoint one reduces the nulls at 3.5 to 6 GHz, whereas by providing the chokes one eliminates the nulls below 3.5 GHz.

Note that if one has a reversal of current at or about the feedpoint of a dipole one has a far field generated by this phase-reversed current. The current along the antenna and the phase-reversed current at the feedpoint add up to zero because of the phase differences, thus to create a null.

As mentioned above, it is noted that one has phase reversals occurring around 2.2 and 2.5 GHz. What is done by the use of the sleeves is to shorten the length of the antenna so that these sleeves make the antenna look shorter, thereby precluding any chance of having phase reversals of the current along the antenna.

With respect to VSWR, it is noted that when there are frequencies at which there is a phase reversal, one gets a high impedance condition at the center of the antenna such that it goes from a nominal 50 ohms to 2 to 300 ohms.

The result of the above is that the continuous band antenna can operate above 2 GHz, thus to capture the WiFi band from 5.5 to 5.75 GHz as well as the WiFi band at 2.4 GHz. There are also other important bands, for instance at 2.5 GHz and one at 3 GHz, that are utilized for WiFi communication; and it is extremely important to be able to listen to and also jam WiFi signals in these bands.

512 MHz-700 MHz

Figure 22:
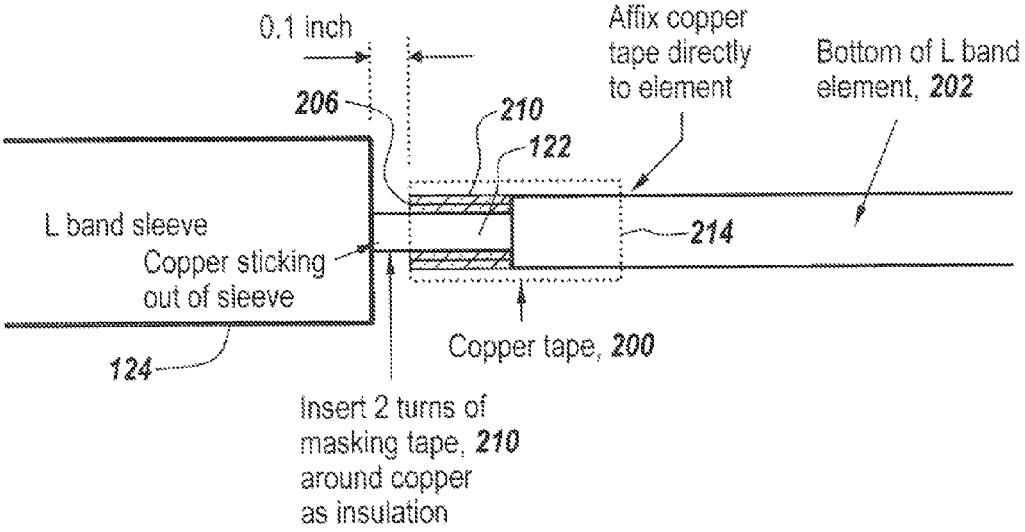
FIG. 22 is a diagrammatic illustration of the utilization of a copper tape implemented sleeve capacitor for effectively extending the length of the L-band antenna to extend operation from 700 MHz down to 512 MHz due to the antenna lengthening effect of the capacitor.

Referring now to FIG. 22, another improvement to the whip antenna described hereinabove is to be able to expand the broadband whip antenna coverage down from 700 MHz to 512 MHz. The problem with the antenna described above is that the VSWR is relatively high in the 512-700 MHz band.

In order to reduce the VSWR for this band, copper tape 200 is physically attached to the bottom of the L-band element, here illustrated at 202, with the copper tape affixed directly to the bottom of the element at one end 204 of the copper tape. The other end 206 of the copper tape is left to freely float over the tube 122 that extends from copper sleeve 124.

It is noted that two turns of masking tape 210 encircle the tube 122 to provide insulation between end 206 of copper tape 200 and tube 122.

It has been found as a result of the above that the VSWR between 512 and 700 MHz is below 3:1 due to the added capacitance provided by the sleeve formed by copper tape 200. The added capacitance is between the bottom end of the L-band antenna and tube 122. It has been found that adding a capacitance between these two elements drastically lowers the VSWR because it lowers the resonant frequency of the entire structure. What one is doing by the adding of the capacitance is to make the L-band antenna look like a longer antenna below 700 MHz due to the adding of the capacitance, thus to support operation down to 512 MHz.

450 MHz-512 MHz

Figure 20:
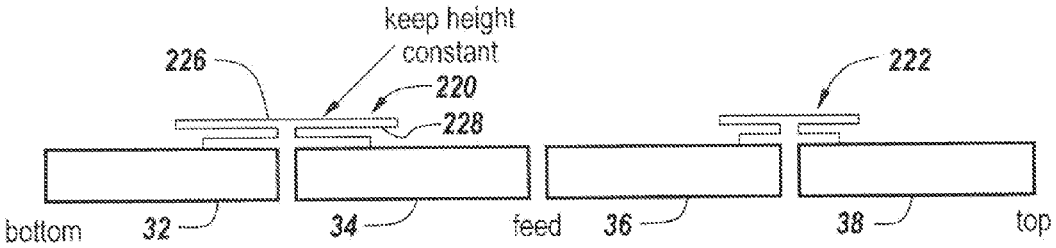
FIG. 20 is a diagrammatic illustration of the utilization of double shielded meanderlines between adjacent antenna sections for the purpose of extending the frequency response of the antenna.

The final improvement to the whip antenna is the utilization of double meanderlines as illustrated in FIG. 20. Here double meanderlines 220 and 222 replace single meanderlines 126 and 128, such that as illustrated at FIG. 20 double meanderline 220 is positioned across elements 32 and 34, whereas double meanderline 222 is positioned across elements 36 and 38. Thus, all meanderlines in the improved antenna are double shielded meanderlines. The doubling of the meanderlines refers to the fact that the left hand side is a mirror image of the right hand side. On the left hand side of meanderline 220 is a left hand folded or shielded meanderline 226 and to the right hand side is a right hand folded or shielded meanderline 228.

How these double meanderlines improve the performance between 450 and 512 MHz is as follows. While the meanderline chokes on the previous broadband antenna are two-fold photonic band gap devices, the double shielded meanderlines make the meanderline chokes four-fold photonic band gap devices. The result is that the cutoff frequency associated with the meanderlines has a sharp knee or a sharp cutoff and therefore moves the cutoff frequency of the antenna upward.

Figure 21:
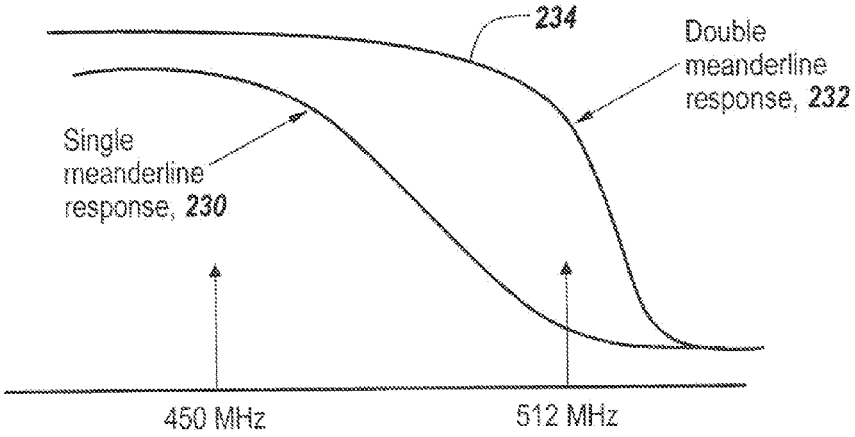
FIG. 21 is a graph of frequency versus amplitude comparing a single meanderline response to a double meanderline response, illustrating a sharper knee in the double meanderline response to extend to 512 MHz.

This is shown in FIG. 21 which for a single meanderline response, here illustrated at 230, there is a gradual drop-off in response from 450 MHz to 512 MHz. On the other hand, the double shielded meanderline response 232 shows a sharp knee 234 which extends the operating frequency of the antenna up to 512 MHz without a significant drop in response.

Figure 23:
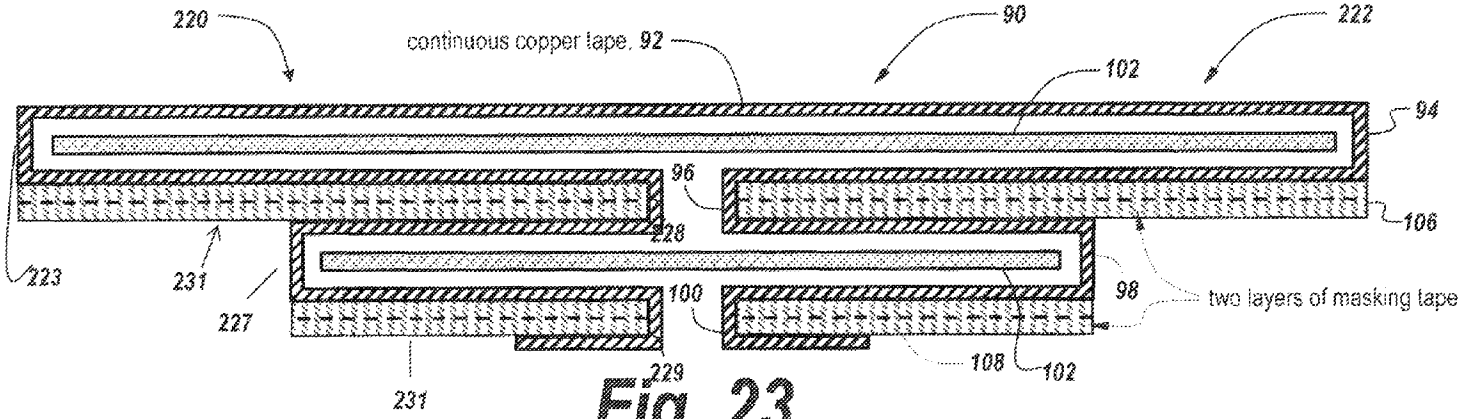
FIG. 23 is a cross sectional view of the double shielded meanderlines used in FIG. 20.

Referring now to FIG. 23, the double shielded meanderline structure is illustrated. What is shown on the right hand side of this drawing is the original single sided shielded meanderline structure which includes a serpentine metalized portion of continuous copper tape 92 folded back at 94 and again at 96 and further at 98 and again at 100, so as to provide the aforementioned shielded meanderline construction. What is shown in this figure is that there is a mirror image of this meanderline shown at 220 to include a continuation of continuous tape 92 which is folded back at folds 223, 225, 227 and 229, with the single layer of masking tape 102 extended to the left as illustrated and with additional two layers of masking tape 231 positioned as illustrated.

Note that single layer 102 adjacent fold 98 is extended to the left so that it is also adjacent fold 227.

Figure 10:
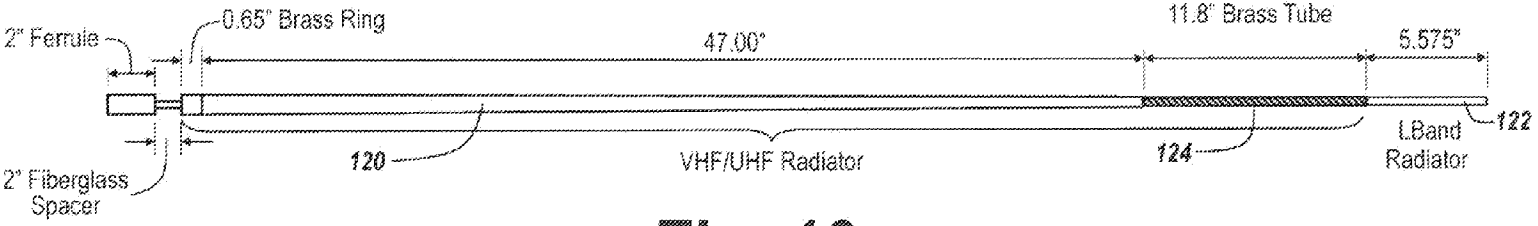
FIG. 10 is a diagrammatic illustration of the construction of the subject multi-band antenna of FIGS. 2-6 including the provision of a fiberglass inner tube mounted to a brass ring and a ferrule at one end and a brass tube that forms one of the dipole elements.
Figure 11:
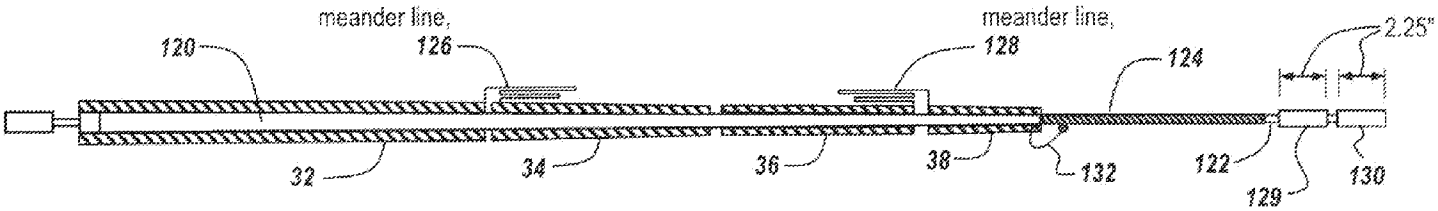
FIG. 11 is a diagrammatic illustration of the construction of the antenna of FIG. 10 illustrating the provision of shielded meanderlines between adjacent dipole sections to either side of the VHF/UHF feed point.
Figure 24:
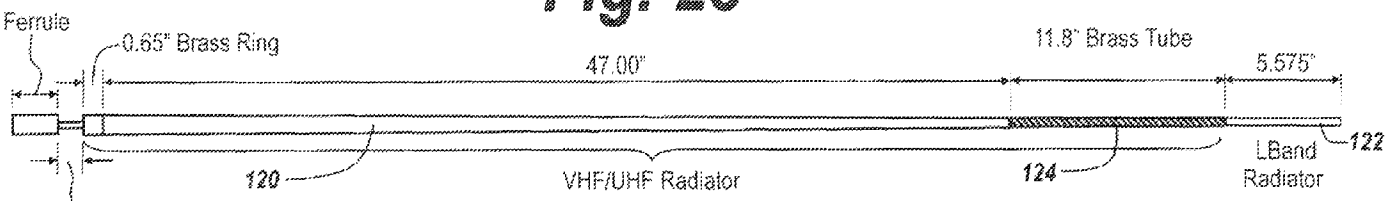
FIG. 24 is a diagrammatic illustration of the construction of the VHF/UHF and L-band radiator of the subject invention.

It will be noted that in FIG. 24 wherein like elements are given like reference characters between FIG. 10 and FIG. 24, the overall dimensions of the original antenna are unaltered.

Figure 25:
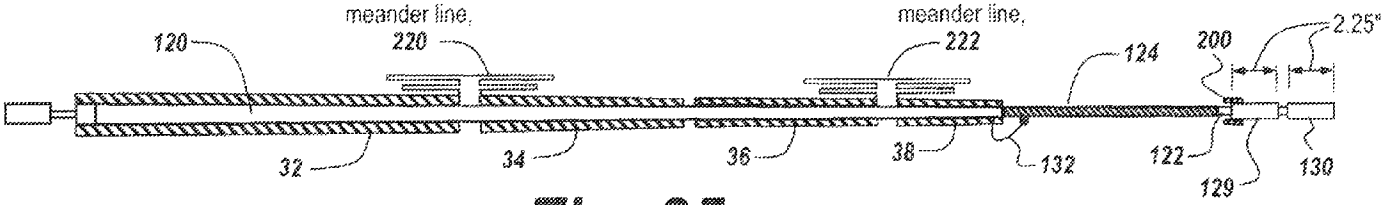
FIG. 25 is a diagrammatic illustration of the utilization of the double meanderlines of FIGS. 20 and 23, as well as the utilization of the capacitor sleeve at one end of the L-band antenna of FIG. 24.

Referring to FIG. 25, what will be seen is that the original meanderlines 126 and 128 are replaced with double shielded meanderlines respectively 220 and 222 so as to bridge elements 32 and 34 and elements 36 and 38 respectively.

Also shown in FIG. 25 is the positioning of copper tape sleeve 200 secured at one end to element 129, with its other end left free over tube 122.

Figure 26:
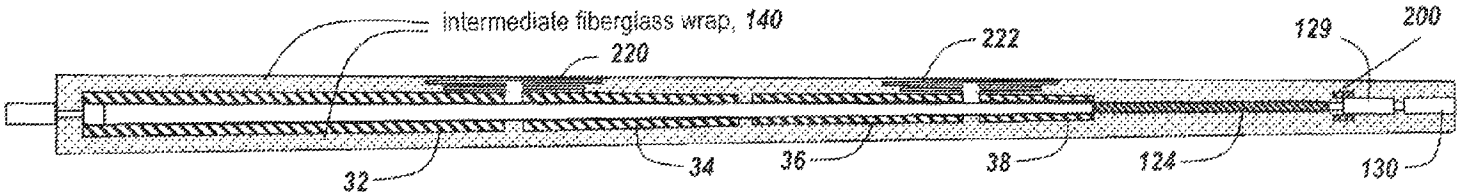
FIG. 26 is a diagrammatic and cross sectional view of the antenna of FIG. 25 illustrating the coating of the elements of FIG. 25 with an outer intermediate fiber glass wrap.
Figure 27:
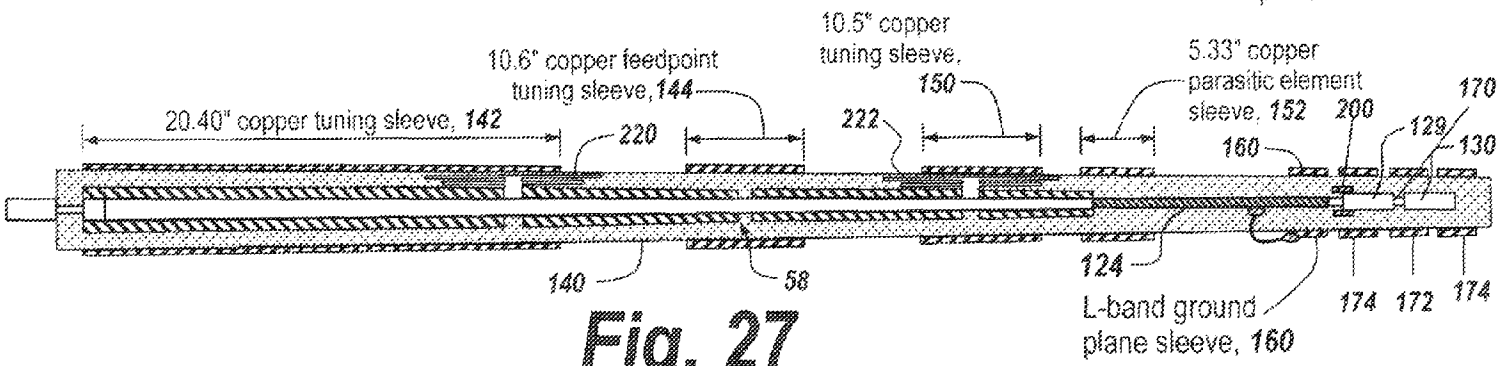
FIG. 27 is a diagrammatic illustration of the antenna of FIG. 26 illustrating the placement of an elongated sleeve over the feedpoint of the L-band antenna, the chokes at the distal ends of the L-band antenna and the capacitive sleeve at one end of the L-band antenna; and, FIG. 28 is a diagrammatic illustration of the completed whip antenna in which the exposed elements are overlain with an outer fiber glass wrap.

As priorly, and referring now to FIG. 26, an intermediate fiber glass wrap wraps the structure of FIG. 25, whereas in FIG. 27 overlying sleeves to the left of sleeves 160 have been described hereinbefore.

Note that the double shielded meanderline structures are overlain with the copper tubing as illustrated. Note also that copper sleeve 200 is overlain with choke sleeve 174, as is L-band dipole end 129, whereas the other end 130 of the L-band antenna is overlain with choke sleeve 174.

Figure 18:
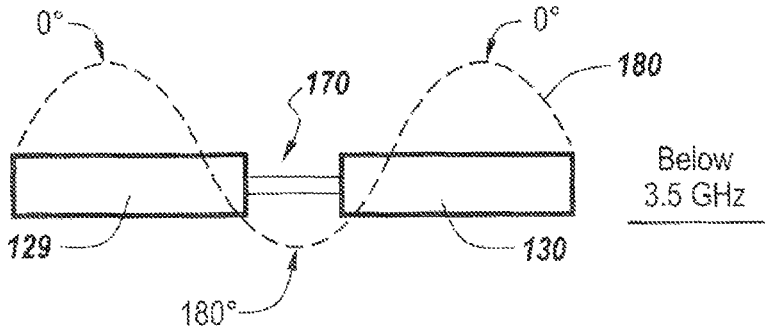
FIG. 18 is a diagrammatic illustration of the current distribution across the dipole antenna of FIG. 15 below 3.5 GHz showing the 180° phase reversal of the current at the feedpoint.
Figure 19:
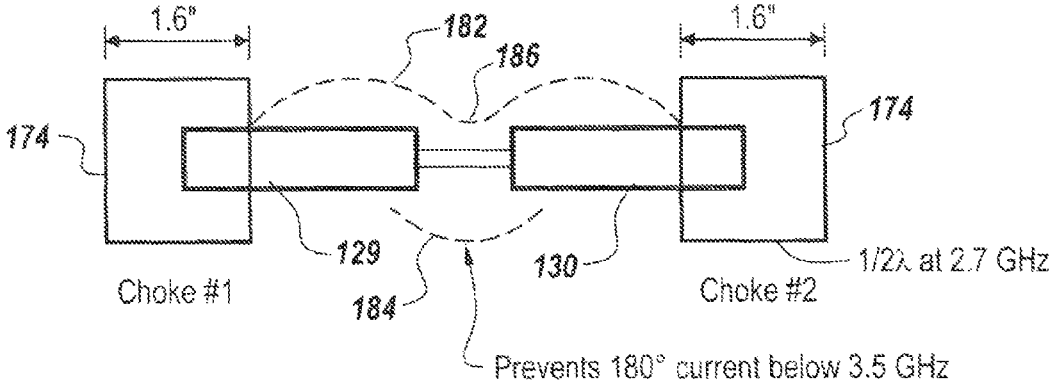
FIG. 19 is a diagrammatic illustration of the antenna of FIG. 18 showing the utilization of sleeves that form chokes for the ends of the L-band dipole antenna in which the negative going or 180° phase shifted current below 3.5 GHz current is choked off when the resonant length of the chokes is one half wavelength at 2.7 GHz.

Over feedpoint 170 is the expanded tuning sleeve 172, thus to correspond to the improvements shown in FIGS. 17-19.

Figure 28:
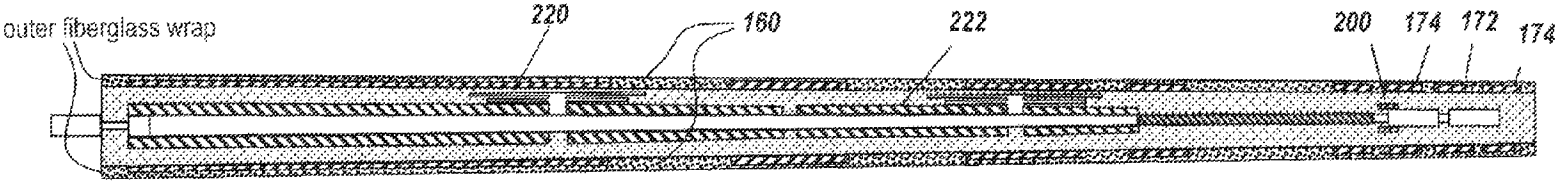

Finally, as illustrated in FIG. 28 the entire antenna is provided with an overlying fiber glass wrap in which the double meanderlines 220 and 222 as well as sleeves 200, 172 and 174 are provided with protective covering in the finalized antenna.

The result is a completed antenna which is easily manufactured and carries the same dimensions as the original antenna but in which the performance is extended to 6 GHz, with nulls and VSWR problems associated with the original antenna solved as described above.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A multiband whip antenna comprising a coaxial line feed running through a plurality of tubular sections to an L-band dipole having a feedpoint, wherein the L-band dipole is configured to increase the bandwidth of the multiband whip antenna 6 GHz;

a double shielded meanderline structure comprising a right hand side and a left hand side, said left hand side being a mirror image of said right hand side, said right hand side having a meanderline structure folded back on itself a number of times, with the top portion of the folded structure extending over the top to the mirror image of the folded shielded meanderline, such that there is a continuous meanderline folded structure from the right hand side to the left hand side; and a sleeve surrounding the L-band feedpoint configured to minimize reverse polarity currents at the L-band feedpoint.

* * * * *